US008587388B2

(12) United States Patent
Ingalls et al.

(10) Patent No.: US 8,587,388 B2
(45) Date of Patent: Nov. 19, 2013

(54) MULTI-SECTION VELOCITY COMPENSATED MICROSTRIP DIRECTIONAL COUPLER

(75) Inventors: Mark W. Ingalls, Spring, TX (US); John Williams, Milford, DE (US); James R. Callaway, Melbourne, FL (US)

(73) Assignee: Spectrum Control, Inc., Fairview, PA (US)

( * ) Notice: Subject to any disclaimer, the term of this patent is extended or adjusted under 35 U.S.C. 154(b) by 12 days.

(21) Appl. No.: 12/703,500

(22) Filed: Feb. 10, 2010

(65) Prior Publication Data

US 2010/0225416 A1 Sep. 9, 2010

Related U.S. Application Data

(60) Provisional application No. 61/151,365, filed on Feb. 10, 2009.

(51) Int. Cl.
*H01P 5/18* (2006.01)
*H01P 3/08* (2006.01)

(52) U.S. Cl.
USPC ..... 333/116; 333/238

(58) Field of Classification Search
USPC ..... 333/109, 110, 111, 112, 115, 116, 238
See application file for complete search history.

(56) References Cited

U.S. PATENT DOCUMENTS 3,593,208 A * 7/1971 Smith ..... 333/112

* cited by examiner

*Primary Examiner* — Dean O Takaoka
(74) *Attorney, Agent, or Firm* — RatnerPrestia

(57) ABSTRACT

A directional coupler having (a) a first coupled microstrip section having a first terminus (T1) and a second terminus (T2), (b) a second coupled microstrip section having a first terminus at T2 and a second terminus (T3), and (c) a first phase-velocity-compensating capacitor connected across the conductors of the microstrip sections at T2 is disclosed. The coupler also may include a second phase-velocity-compensating capacitor connected at T1, and a third phase-velocity compensating capacitor connected across the conductors at T3.

13 Claims, 7 Drawing Sheets

MULTI-SECTION VELOCITY COMPENSATED MICROSTRIP DIRECTIONAL COUPLER

CROSS-REFERENCE TO RELATED APPLICATION

This application claims the benefit of priority to U.S. provisional patent application Ser. No. 61/151,365, filed on Feb. 10, 2009.

FIELD OF THE INVENTION

The present invention relates to directional couplers.

BACKGROUND OF THE INVENTION

Directional couplers are used for sampling a signal in one direction only. Ideally, the signal is sampled without changing the signal's characteristics, in one propagating direction only. FIG. 1 schematically depicts a directional coupler. Four signal ports are shown: "input," "output," "coupled" (a.k.a. "sampled") and "isolated." The isolated port is sometimes placed inside the physical device and is often terminated in such a way as to prevent a reflected signal from reaching the other three ports. For example, the isolated port may be terminated with a matched load. Although it is possible to create a directional coupler using lumped elements, such as capacitors and mutual inductors, most practical circuits are realized by using coupled transmission lines.

Directional couplers may be understood by considering the modes of transverse electromagnetic (TEM) propagation. Whenever it becomes possible for oppositely polarized current pairs to flow in a structure, that structure may be said to support a TEM mode. A pair of conductors can support one TEM mode while three conductors can support two independent TEM modes. It can be shown that N+1 conductors can support N independent TEM modes of propagation, and that all TEM propagation can be modeled as a linear combination of the N independent modes. Thus, three conductors can be arranged so that driving one mode of propagation results in a second electromagnetically induced mode of propagation. This induced mode is the so-called "coupled" or "sampled" mode.

One measure of a coupler's ideality is the coupler's directivity. Directivity is a ratio of (a) the forward sampled power (i.e. the power traveling from the input port to the output port) to (b) the reverse sampled power (i.e. the power traveling from the output port to the isolated port), when the power is intended to be sampled from the forward traveling signal and the forward and reverse traveling signal amplitudes are equal. Among the factors that can spoil a coupler's directivity is a difference in phase velocity between modes. In the case of microstrip directional couplers, which are normally comprised of coupled transmission lines mounted on a printed wiring board ("PWB"), this problem becomes more pronounced as the relative permittivity ($\in_r$) of the PWB is increased.

FIGS. 2*a* and 2*b* illustrate the problem created by the relative permittivity of the PWB. In FIG. 2*a*, there is shown a three-conductor coupled microstrip in the so called "even mode", in which two of the conductors 10, 20 are either charged to a negative potential or a positive potential and the third conductor 30 is neutral. In FIG. 2*a*, two of the conductors 10, 20 are charged to a positive potential. In FIG. 2*b*, there is shown the same coupled microstrip in the so called "odd mode", in which one of the conductors 10 is positively charged, another of the conductors 20 is negatively charged, and the third conductor 30 is neutral. Dotted areas symbolize the dielectric material of the PWB. In the even mode, the E-field is concentrated in the PWB, which has a higher $\in_r$ than air, and the phase velocity of the even-mode signal is lower than the free-space velocity due to this dielectric loading. In the odd mode, some of the E-field maps into the air region above the PWB, raising the phase velocity of the odd-mode signal compared to the even mode. So, because the E-field in the even mode disperses differently than the E-field in the odd mode, there is a difference in phase velocity between the even and odd modes. As such, the load at the isolated port may be matched for one of the modes (even or odd) but not the other mode. An unmatched load for one or both modes results in energy being reflected by the port corresponding to the unmatched load, resulting in non-ideal behavior, e.g., poor isolation. Ideally, each port of the directional coupler would have a matched load for all propagating modes.

Techniques for compensating for the odd-mode phase velocity of a microstrip directional coupler are well known. Such techniques include placing capacitors at the ends of the microstrip directional coupler. Since it takes time to charge and discharge capacitors, the odd-mode phase velocity is effectively retarded by incorporating capacitors at the ends of the coupled microstrip section.

A directional coupler is a reactive device, and thus has a finite operational bandwidth. The operational bandwidth is the frequency range over which a coupler is considered to accurately indicate characteristics of a signal at a particular power level. In order to increase the operational bandwidth, multiple sections of coupled lines are often added in series in order to expand the operational bandwidth. However, when an existing multi-sectioned directional coupler is operated in the odd mode, the phase velocity difference associated with one of the sections is different from the phase velocity difference associated with another of the sections. The dissimilar phase velocities associated with each of the sections makes it difficult to compensate for the phase velocity difference between even and odd modes across the desired operational bandwidth of the multi-sectioned coupler. Consequently, the difference in phase velocity between modes makes it difficult for microstrip couplers to compete with other types of coupled transmission lines (e.g., strip line).

Microstrip fabrication techniques are simpler and cheaper than other fabrication techniques (e.g. manufacturing techniques used to manufacture stripline couplers). So, there is a strong incentive to try to ameliorate the problems caused by the phase velocity difference between the even and odd modes in a multi-sectioned microstrip directional coupler.

SUMMARY OF THE INVENTION

The invention may be embodied as a directional coupler having (a) a first coupled microstrip section having two conductors extending from a first terminus (T1) of the first coupled microstrip section to a second terminus (T2) of the first coupled microstrip section, (b) a second coupled microstrip section having two conductors extending from a first terminus at T2 to a second terminus (T3) of the second coupled microstrip section, and (c) a first phase-velocity-compensating capacitor with one of its leads connected to a first one of the conductors at T2, and the other of its leads connected to a second one of the conductors at T2. The coupler also may include a second phase-velocity-compensating capacitor connected at T1, and a third phase-velocity compensating capacitor connected at T3. The capacitors of the coupler may be formed from one or more discrete capacitors.

An isolated port of the coupler may be internal to a housing of the coupler.

One or more of the capacitors may be a multilayer surface mount capacitor or a single layer capacitor mounted edge-wise between coupled line sections.

At least one of the capacitors may be an integral part of conductors forming one of the microstrip sections. In such an arrangement, the dielectric material of the capacitor may be air.

As such, a directional coupler according to the invention may include a first coupled microstrip section electrically connected to a second microstrip section at a junction, and a phase-velocity-compensating capacitor connected at the junction across conductors of the microstrip sections. Such a directional coupler may include a second phase-velocity-compensating capacitor connected across conductors of the first coupled microstrip section, but not across conductors of the second coupled microstrip section, and a third phase-velocity compensating capacitor connected across conductors of the second coupled microstrip section, but not across conductors of the first coupled microstrip section.

The capacitors may be electrically connected to one or more of the microstrip sections by soldering, brazing, welding or other conductive connection. The capacitors may be connected to one or more of the microstrip sections by means of conductive wire bonds, ribbon bonds or mesh bonds.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
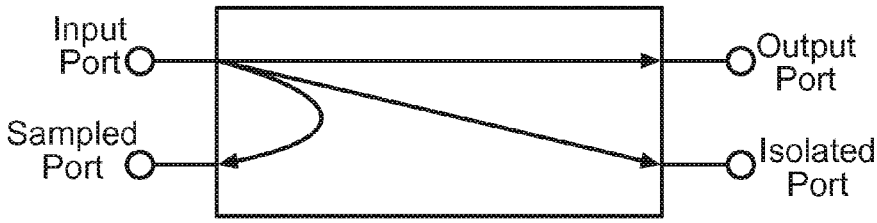
FIG. 1 is a schematic of a directional coupler.
Figure 2A:
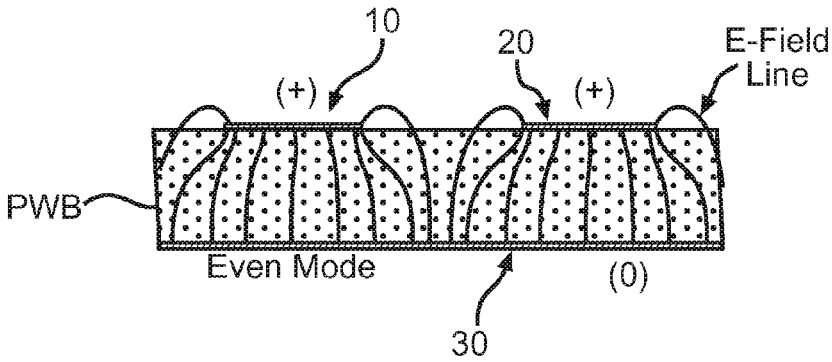
FIG. 2*a* depicts three conductors of a microstrip directional coupler and a printed wiring board, as well as a mapping of the E-field in the even mode.
Figure 2B:
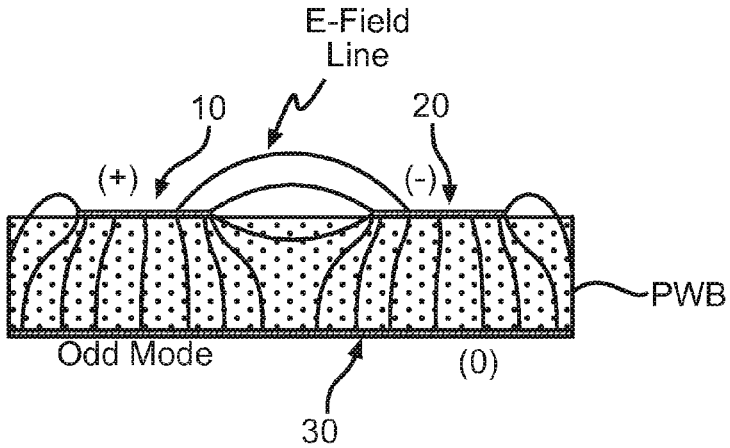
FIG. 2*b* is similar to FIG. 2*a* in that it depicts the conductors and printed wiring board, but differs from FIG. 2*a* in that FIG. 2*b* maps the E-field in the odd mode.
Figure 3A:
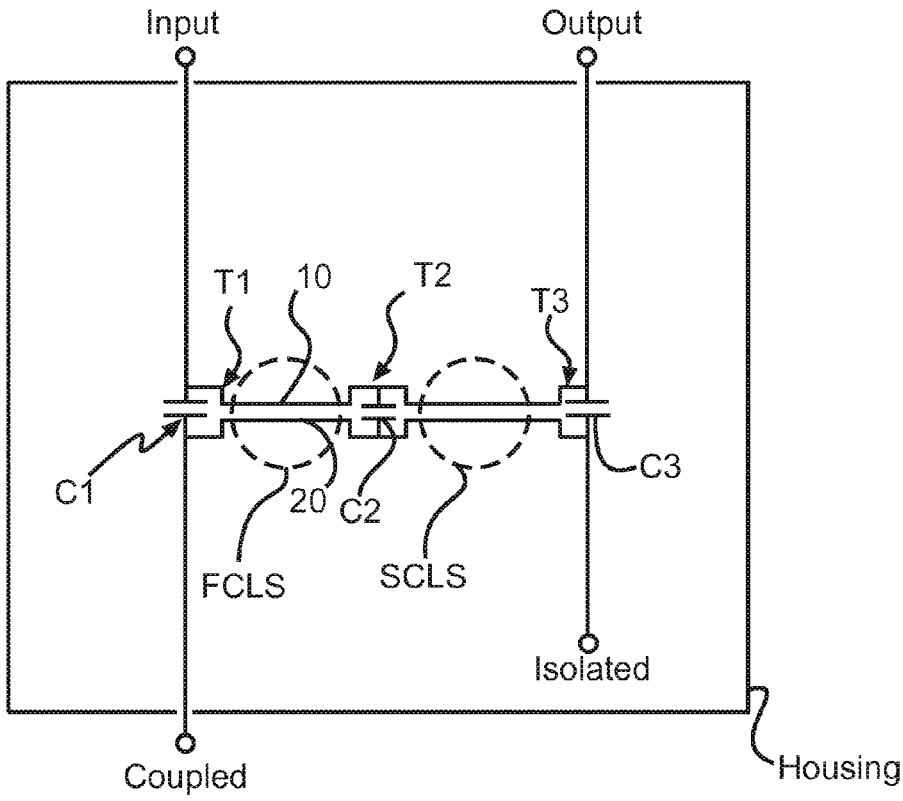
FIG. 3*a* is a schematic that depicts two coupled microstrip line sections according to the invention.

The invention seeks to achieve a more nearly ideal directivity in a compact package over a broad frequency range by incorporating a capacitor in a multi-sectional directional coupler at the junction between coupled line sections. FIG. 3*a* depicts an embodiment of the invention. In FIG. 3*a* there is shown a first coupled line section ("FCLS") that has a first terminus at T1 and a second terminus at T2. A capacitor C1 is electrically connected across conductors of the FCLS at the first terminus T1 of the FCLS, and a capacitor C2 is electrically connected across conductors of the FCLS at the second terminus T2 of the FCLS. The FCLS may be designed to have a first bandwidth, within which the FCLS is considered to accurately indicate characteristics of a signal supplied to the input port.

The embodiment of the invention depicted in FIG. 3*a* also has a second coupled line section ("SCLS"). The SCLS has a first terminus at T2 and a second terminus at T3. As such, the second capacitor C2 is electrically connected across the conductors of the SCLS at T2. A third capacitor C3 is electrically connected across the conductors of the SCLS at the second terminus T3 of the SCLS. The SCLS may be designed to have a second bandwidth, within which the SCLS is considered to accurately indicate characteristics of the signal supplied to the input port.

Figure 3B:
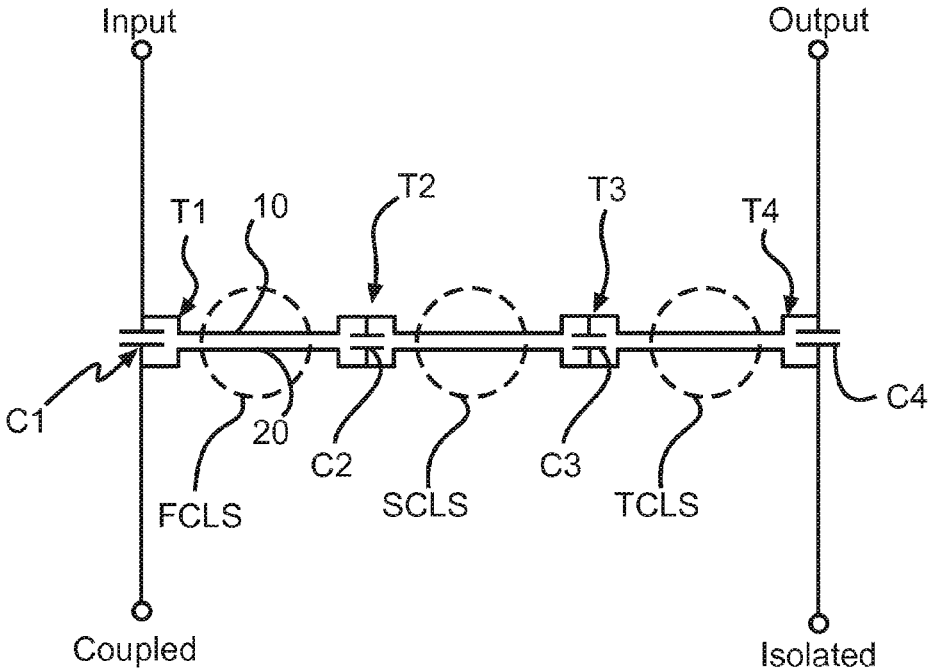
FIG. 3*b* is a schematic that depicts three coupled microstrip line sections according to the invention.

The invention is not limited to two coupled line sections and three capacitors. Additional coupled line sections and capacitors may be appended. For example, FIG. 3*b* depicts an embodiment of the invention having a third coupled line section ("TCLS"). The TCLS may be designed to have a third bandwidth, within which the TCLS is considered to accurately indicate characteristics of the signal supplied to the input port. The TCLS has a first terminus at T3 and a second terminus at T4. As such, the third capacitor C3 is electrically connected across the conductors of the TCLS at T3. A fourth capacitor C4 is electrically connected across the conductors of the TCLS at the second terminus T4 of the TCLS.

The capacitance of the capacitors may be selected in order to minimize the phase velocity difference between the even and odd modes. Ideally, the capacitance at each coupled line terminus is selected so that the effective odd-mode phase velocity matches the even-mode phase velocity for each coupled line section. The resulting device may have the characteristics of a single dielectric structure (e.g. stripline) with the ease of production associated with microstrip directional couplers. Also, a surprising result of using capacitors at the termini between coupled line sections is that the length of the coupled microstrip lines can be reduced, thereby allowing a more compact structure than was previously possible with coupled transmission lines alone.

One or more of the capacitors used in a directional coupler according to the invention may be a multi-layer surface mount capacitor. Such a capacitor has the advantage of being readily available, for example via a parts catalog.

Figure 4:
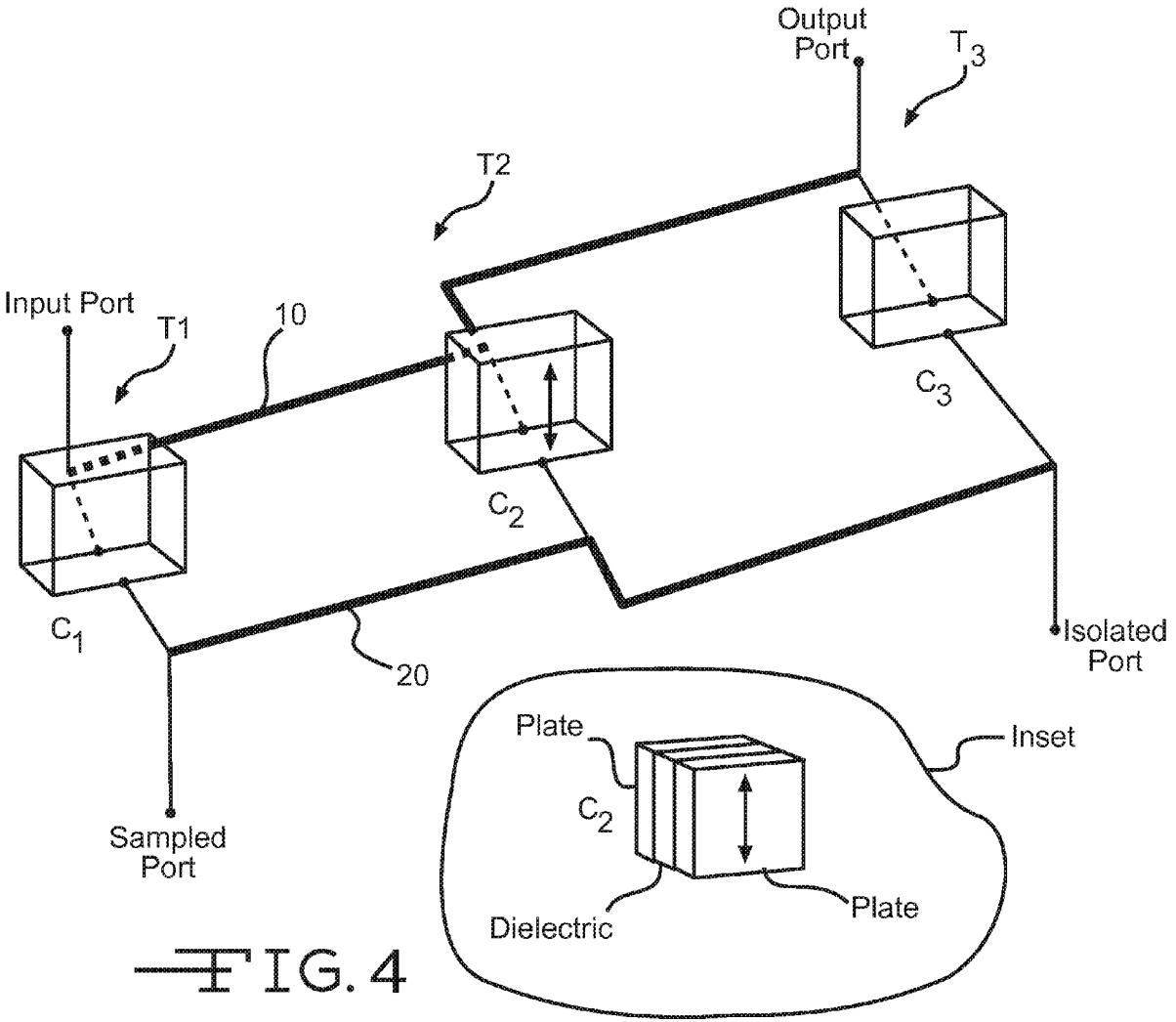
FIG. 4 is a schematic of the invention in which a capacitor is oriented so that the plates of the capacitor are perpendicular to a plane in which the conductors reside.

One or more of the capacitors used in a directional coupler according to the invention may be a single-layer capacitor mounted edge-wise between coupled line sections. FIG. 4 depicts such an embodiment of the invention. In such an arrangement, the plates of the capacitor may be oriented substantially perpendicular to a plane in which the conductors 10, 20 reside. Such a capacitor has the advantage of lower parasitic inductance, and may have desirable characteristics at high frequencies. Further advantages may include an improved ability to obtain a desired combination of physical size and price.

In FIG. 4, capacitor C2 is shown in more detail in the inset to better convey the orientation of the plates. The arrow on C2 is provided to assist in understanding the orientation of the capacitor plates.

Figure 5:
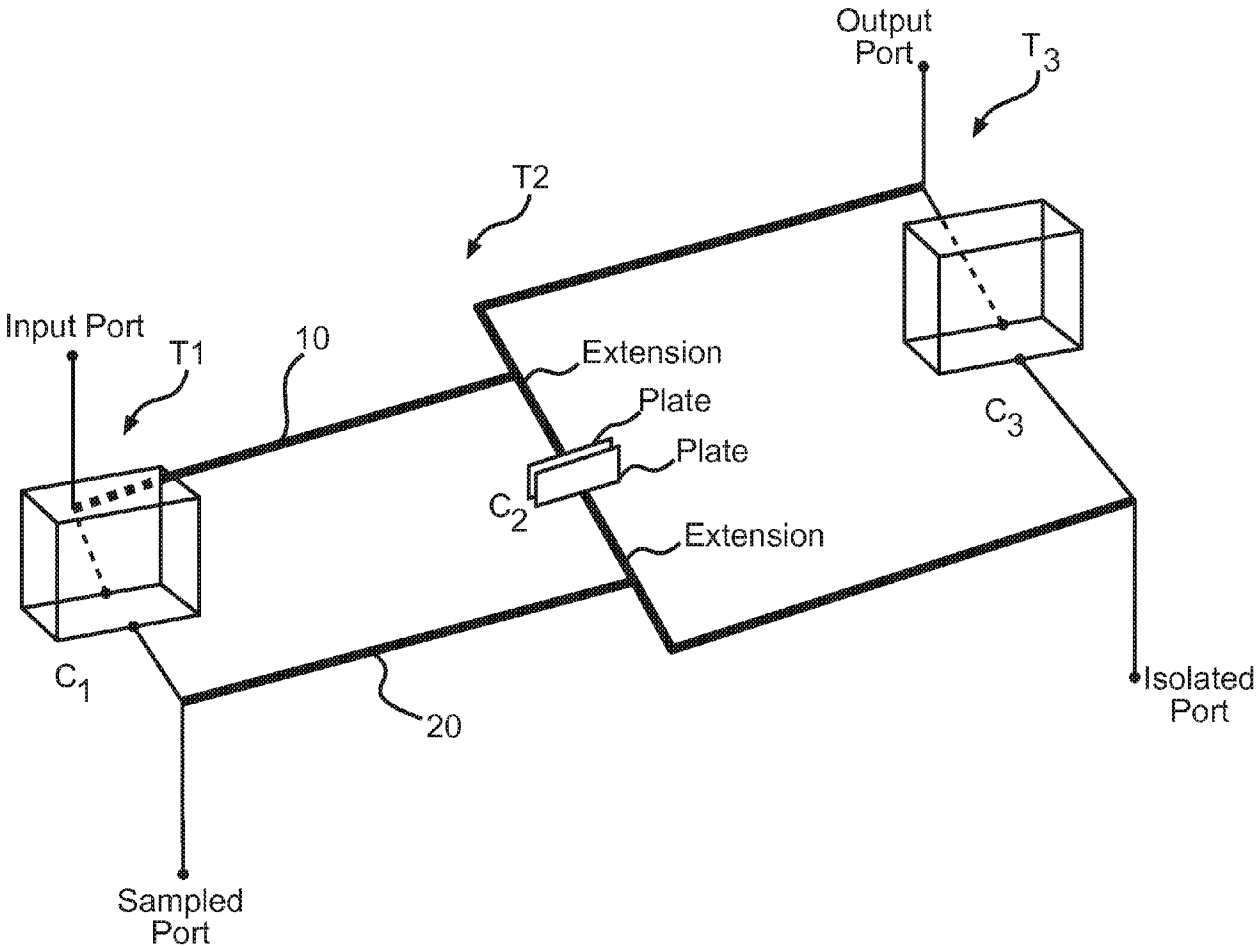
FIG. 5 is a schematic of the invention in which a capacitor includes an integral extension from each conductor and a dielectric between the extensions.

It should be noted that one or more of the capacitors may be formed as an integral part of the microstrip directional coupler, rather than as a separate and distinct part of the circuit. In one such embodiment, the microstrip conductors 10, 20 may have extensions which extend toward each other but do not touch. A dielectric material may be placed between the extensions. For example, the dielectric material may be air. FIG. 5 depicts such an embodiment of the invention.

One or more of the capacitors described above need not be formed from a single discrete capacitor. For example, in order to obtain the desired capacitance, more than one discrete capacitor may be used.

Figure 7A:
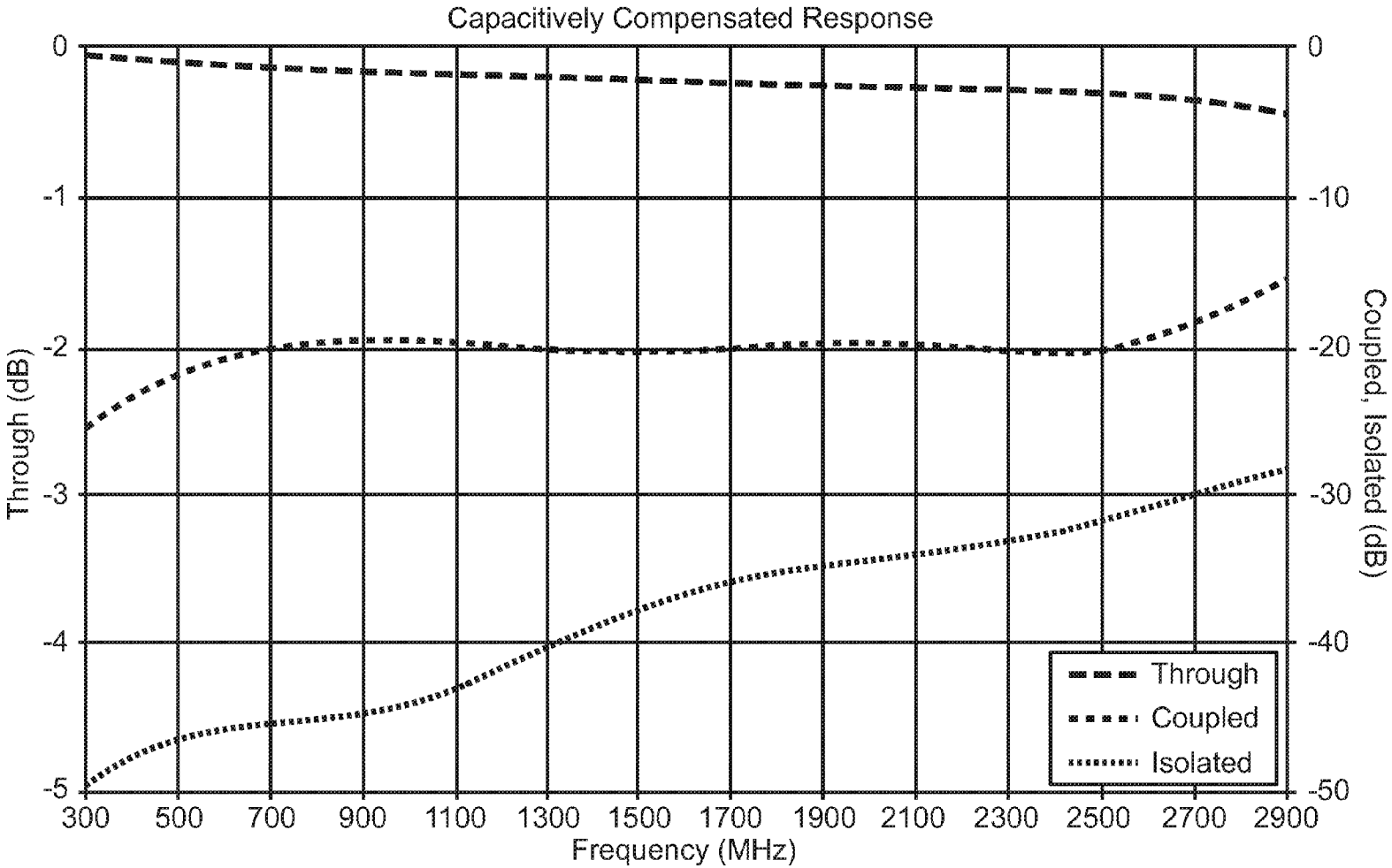
FIG. 7*a* depicts aspects of the response from the coupler depicted in FIG. 3*b*.

FIG. 7*a* depicts a simulated response of the inventive directional coupler shown in FIG. 3*b*. For a particular input signal, FIG. 7*a* depicts the signal strength for the output port, isolated port and through port of a directional coupler that is in keeping with the invention. Ideally, the signal measured at the isolated port is as close to zero as possible.

Figure 6:
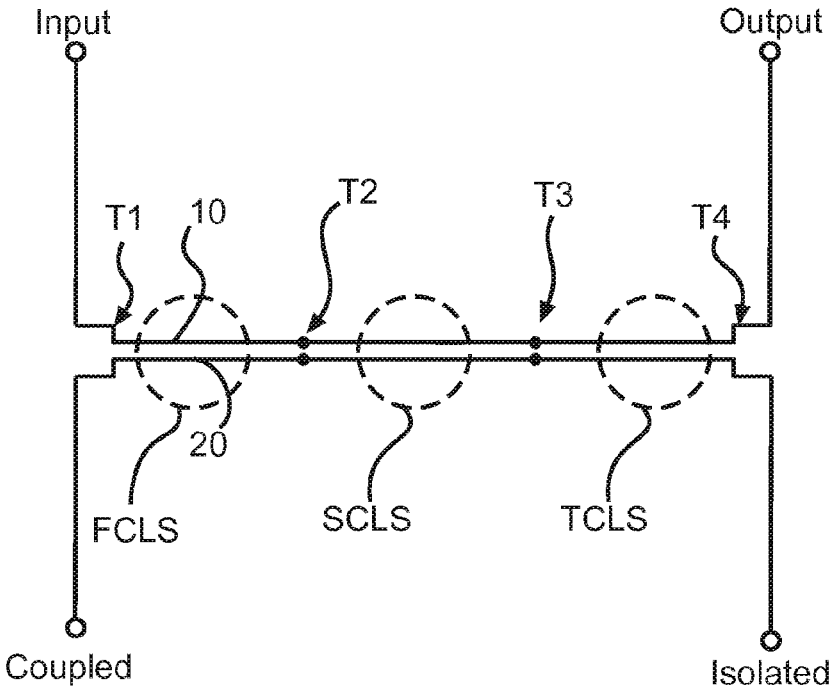
FIG. 6 (Prior Art)
FIG. 6 is a schematic that depicts three coupled microstrip line sections without capacitors.
Figure 7B:
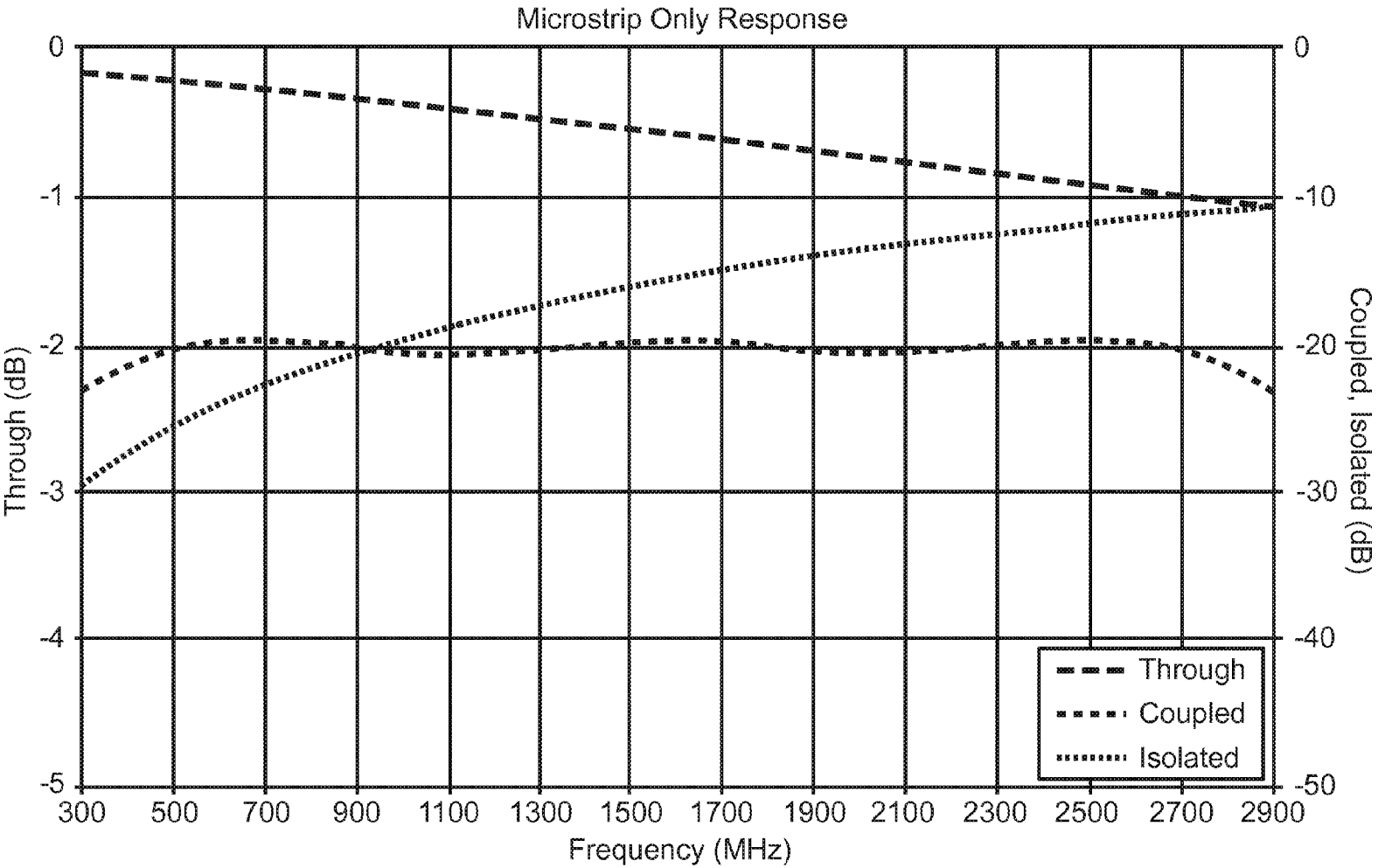
FIG. 7*b* depicts aspects of the response from the coupler depicted in FIG. 6.

By way of comparison, FIG. 6 depicts a three-section microstrip directional coupler which does not have capacitors at the termini between coupled line sections. FIG. 7*b* depicts a simulated response of the directional coupler shown in FIG. 6. It should be noted that the signal strength measured at the isolated port is much higher in FIG. 7*b* than in FIG. 7*a*, thus illustrating that the invention provides a significant improvement. By applying the conservation-of-energy principle, it can be shown that the through response of the directional coupler in FIG. 3*b* has less power loss than the directional coupler in FIG. 6.

The invention may include additional features. For example, the isolated port of the directional coupler may be placed inside a protective housing. This may be done in order to save money by eliminating the need for a connector or other termination of the isolated port.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A directional coupler, comprising:

a first coupled microstrip section having two conductors extending from a first terminus (T1) to a second terminus (T2);

a second coupled microstrip section having two conductors extending from a first terminus at T2 to a second terminus T3;

a first phase-velocity-compensating capacitor connected across the conductors at T2; and wherein the coupler has an isolated port that is internal to a housing of the coupler.

2. The coupler of claim 1, further comprising:

a second phase-velocity-compensating capacitor connected at T1; and a third phase-velocity compensating capacitor connected across the conductors at T3.

3. The directional coupler of claim 1, having more than one phase-velocity-compensating capacitor at a terminus of a coupled line section.

4. The directional coupler of claim 1, wherein at least one of the capacitors is a multilayer surface mount capacitor.

5. The directional coupler of claim 1, wherein at least one of the capacitors is a single layer capacitor mounted edgewise between coupled line sections.

6. The directional coupler of claim 1, wherein at least one of the capacitors is an integral part of conductors forming one of the microstrip sections.

7. The directional coupler of claim 6, wherein the at least one of the integrated capacitors includes an air-filled gap between extensions of the conductors.

8. A directional coupler, comprising:

a first coupled microstrip section electrically connected to a second microstrip section at a junction, and a phase-velocity-compensating capacitor connected across conductors of the microstrip sections at the junction; and wherein the coupler has an isolated port that is internal to a housing of the coupler.

9. The coupler of claim 8, further comprising:

a second phase-velocity-compensating capacitor connected across conductors of the first coupled microstrip section, but not across conductors of the second coupled microstrip section; and a third phase-velocity compensating capacitor connected across conductors of the second coupled microstrip section, but not across conductors of the first coupled microstrip section.

10. The directional coupler of claim 8, wherein at least one of the capacitors is a multilayer surface mount capacitor.

11. The directional coupler of claim 8, wherein at least one of the capacitors is a single layer capacitor mounted edgewise between coupled line sections.

12. The directional coupler of claim 8, wherein at least one of the capacitors is an integral part of conductors forming one of the microstrip sections.

13. The directional coupler of claim 12, wherein the at least one of the integrated capacitors is an air-filled gap between extensions of the conductors.

* * * * *